United States Patent [19]

Robinson

[11] 4,041,928

[45] Aug. 16, 1977

[54] MASONRY SAW

[75] Inventor: Franklin E. Robinson, West Roxbury, Mass.

[73] Assignee: Norton Company, Worcester, Mass.

[21] Appl. No.: 681,544

[22] Filed: Apr. 29, 1976

[51] Int. Cl.[2] ..... B28D 1/04

[52] U.S. Cl. ..... 125/13 SS

[58] Field of Search ..... 51/268; 125/13 R, 13 SS

[56] References Cited

U.S. PATENT DOCUMENTS

| | | | |
|---|---|---|---|
| 2,180,743 | 11/1939 | Martin | 125/13 SS |
| 2,863,440 | 12/1958 | Harclerode | 125/13 SS |
| 2,972,344 | 2/1961 | Bergen | 125/13 SS |
| 2,998,813 | 9/1961 | Wilson | 125/13 SS |
| 3,834,369 | 9/1974 | Haase | 51/268 |

*Primary Examiner*—Harold D. Whitehead

*Attorney, Agent, or Firm*—Walter Fred

[57] ABSTRACT

A rotary masonry saw has a platform supporting a rotatably driven abrasive saw blade pivotable relative to a work support on a support frame. To position and rock the saw blade, the platform is pivotally linked to an adjustable feed screw and tripivot lever mechanism pivotally mounted on and movable with an upwardly biased foot lever pivotally mounted on the frame. Also provided, is a self leveling saw blade guard mechanism including a guide member having arcuate slots extending between opposed arcuate surfaces in supporting retaining and guiding engagement with grooved follower means attached to the guard. A disconnectable link bar pivotally connects the guard to the frame, pivots and maintains the lower edge of the guard substantially horizontal during pivotal movement of the platform and saw blade.

13 Claims, 4 Drawing Figures

10
12
12a
12b
12c
12d
14
16
18
20
22
24
26
28
30
32
32a
42
42a
42b
42c
44
44a
44b
44c
44d
46
46a
46b
52
54
56
62
62a
64
66
68
68a
70
72
72a
72b
72c
74
74a
76

MASONRY SAW

BACKGROUND OF THE INVENTION

1. Field of the Invention

The invention relates to rotary saws provided with a self leveling protective saw blade guard particularly for rotary masonry saws and the like pivotally mounted on a support frame and an adjustable spring biased positioning mechanism manually operable for initially positioning and rocking the saw blade into and out of cutting engagement with a workpiece.

2. Description of the Prior Art

The prior art discloses rotary saws with various mechanisms similar in some respects for the purpose of initially positioning and rocking the saw blade and maintaining, at all times, the lower edge of the saw blade guard in a horizontal or level position and out of engagement with the workpiece regardless of the amount of relative pivotal movement.

Examples of saw blade positioning and self leveling guard mechanisms of which the applicant is aware are disclosed in the following U.S. Pats. No. 3,834,369; 2,998,813; 2,972,344 and 2,320,743 and in a rotary saw manufactured by Robert C. Evans Co. of Kansas City, Mo. and sold under their trademark TARGET GUARD/MATIC. Each of the mechanisms disclosed in the prior art attain the same objective but in a manner which distinguishes in one or more respects from one another and the applicant's mechanisms disclosed hereinafter.

The applicant's masonry saw distinguishes from the known prior art cited above in that the self leveling guard has followers fixed thereon which are adapted to project into, move in, and be retained in arcuate channels between engaging arcuate guide surfaces on a guide member fixed to and pivotable with the platform.

Also, the applicant's saw blade positioning and pivoting means differs in that an adjustable tripivot lever pivotally linked to an adjusting screw and the platform, is pivotally mounted on, movable with and adjustable relative to a short lever arm of a foot lever pivotally mounted on the frame.

SUMMARY OF THE INVENTION

A rotary masonry saw having a support frame on which is pivotally mounted saw blade positioning and pivoting means, a platform supporting drive means, a shaft journalled in support bearings, a circular saw blade attached to said shaft for rotation about its axis and pivotal movement toward and away from workpiece support means and self adjusting guard mechanism.

The self adjusting guard mechanism comprises a guard supporting guide member extending normal to the shaft axis, fixed to and pivotable with the platform. The guide member has a guideway comprising a plurality of angularly spaced arcuate slots each of which extends between opposed spaced arcuate concentric surfaces in supporting, guiding and retaining engagement with a grooved follower, fixed to and projecting from an adjacent side of the guard into the slots.

Each of the slots has an enlarged portion angularly spaced a predetermined distance about and from the shaft axis and with which the followers position on the guard correspond. The guard may be attached or removed by rotating to an inoperative position, aligning and passing the followers through the enlarged portions of the slots.

A quick disconnect link bar, provided for removal of the guard, pivotally connects the guard to a fixed member on the frame. The link bar pivots the guard about the axis in response to the pivotable movement of the platform relative to the frame and workpiece support.

Means for positioning and rocking the saw blade comprises an elongated foot operated lever bar, including an upwardly extending support bracket and bumper, pivotally attached to the frame and upwardly biased into engagement with the underside of a frame member. A tripivot lever has a first or intermediate pivot connected to and fulcrumed on one end of the foot lever bar. A second or lower pivot attached to a lower end of a push-pull rod is pivotally connected at the upper end to the rearward portion of the platform and a third or upper pivot pivotally connected to one end of an adjustable member internally threaded at its opposite end. A manually operable screw shaft is rotatable and pivotally mounted on the upwardly extending bracket and from which it extends and threadedly engages the adjustable member. Relative movement between the screw shaft and adjustable member pivots the tripivot lever relative to the foot lever which simultaneously raises or lowers the push-pull link bar and hence prepositions the platform and saw blade relative to the work support. Pivotal movement of the foot lever moves the screw shaft adjustable member, and tripivot level attached thereto together relative to the frame and hence the push-pull bar and saw blade.

Therefore, the primary object of the invention is to provide a masonry saw having a self leveling saw blade guard and an adjustable saw blade positioning and pivoting mechanism.

DESCRIPTION OF THE PREFERRED EMBODIMENT(S)

Figures 1, 2, 3, 4:
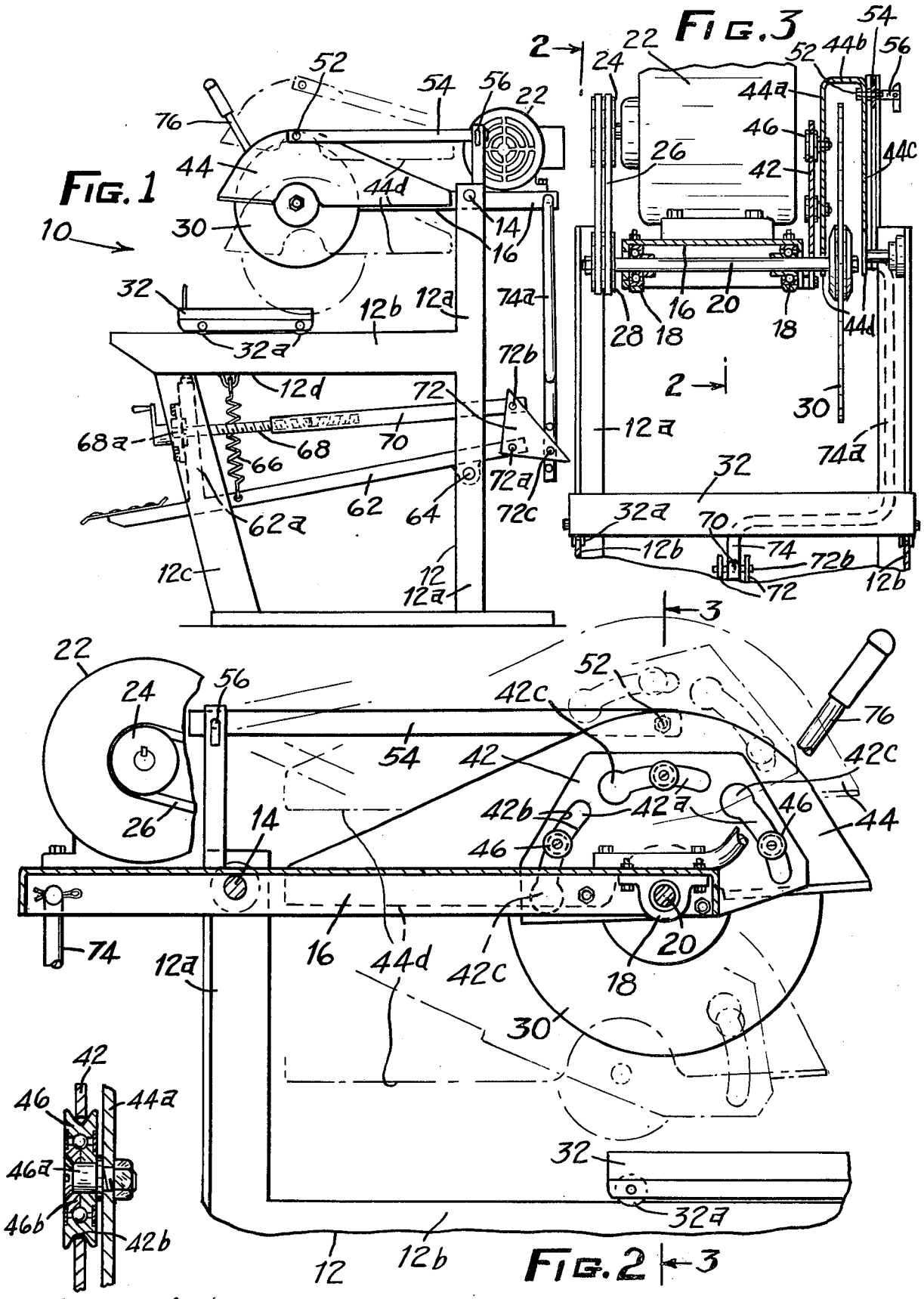
FIG. 1 is a side view of a rotary saw, with the self adjusting saw blade guard and blade positioning mechanisms of the invention mounted thereon.
FIG. 2 is an enlarged partial sectional view of the rotary saw taken on line 2—2 of FIG. 3 showing the supporting, guiding and pivotal components of the self adjusting guard mechanism.
FIG. 3 is a fragmentary sectional view taken on line 3—3 of FIG. 2 showing the arrangement of the guard supporting guide member and engaging followers attached to and movable with the guard.
FIG. 4 is an enlarged sectional view through one of the followers attached to the guard and engaging the guide member.

Referring to FIGS. 1-3 there is shown by way of example, a rotary saw 10 preferably of the type for cutting masonry workpieces. The rotary saw 10 may comprise a frame or support 12 including upwardly extending rear support members **12*a* on which is pivotally mounted and movable about a pivot shaft 14, a platform 16 including attached support bearings 18 at a free end of the platform. A rotatable shaft 20 is journalled in the support bearings and rotated by conventional drive means usually mounted on the platform 16. The drive means preferably comprises a motor 22, to which is attached a drive pulley 24 connected by drive belts 26 to a driven pulley 28 fixed to the shaft 20** journalled in the bearings for rotation about a horizontal axis.

A rotatable circular saw blade 30, such as a conventional abrasive cut-off wheel or a saw blade having diamond abrasive segments or teeth thereon is clamped between wheel flanges including a removable bolt attached to an opposite end portion of the shaft extending axially beyond one side of the platform.

Mounted on the frame 12 is a workpiece support cart or carriage 32 provided with spaced pairs of grooved rollers 32*a* in supporting rolling and guiding engagement with spaced transversely extending guide rails 12*b* on the frame. The cart 32 is movable along the rails 12*b* in a direction transverse to the axis of rotation of the saw blade 30 whereby a workpiece to be cut may be placed on the cart and fed into the path of the saw blade 30.

Alternatively, the saw blade may be fed or rocked into a workpiece supported on a fixed work support or other suitable work support means extending forwardly from the rear members of the frame 12.

A self adjusting saw blade guard mechanism is provided adjacent the saw blade which includes a supporting guide member or plate 42 extending upwardly normal to the axis of the shaft 20, fixed to, spaced from and pivotable with the platform 16. The guide member 42 has guideway means comprising at least one but preferably a plurality of angularly spaced elongated arcuate slots or channels 41*a* between opposed spaced parallel inner and outer arcuate guide surfaces 42*b* extending substantially concentric to the axis of the shaft 20. Each of the arcuate slots 42*a* have essentially a key hole configuration which includes an elongated narrow arcuate channel of substantially constant width and curvature extending from a larger entrance portion, opening or passage 42*c* of greater diameter and width at one end to a semi-circular or curved end surface at the opposite end of the arcuate slot.

A removable saw blade safety guard or hood 44 is pivotally supported, guided and retained on the guide member 42 and encloses substantially an upper half or circular segment of the saw blade 30. The guard 44 has an inner side wall 44*a* situated adjacent to and axially spaced from the guide member 42 and a top wall or cover 44*b* of predetermined axial width, spaced from a peripheral surface portion of the saw blade 30. The top cover or wall 44*b* is arranged to extend axially to an outer wall 42*c* and around a circular segment of the saw blade to opposite end portions at the lower edge or side 44*d* of the guard 44. Preferably the lower edge 44*d* is situated in substantially a horizontal plane.

Attached to and projecting axially from the inner sidewall 44*a* into each of the arcuate slots 42*a* and engagement with the guide surfaces 42*b* in the guide plate 42 is a grooved follower 46 which can be a roller, a nonrotatable circular. member or arcuate member having at least one flange adjacent a recessed surface adapted for guiding and retaining engagement with surfaces of the guide member. Preferably, there are three rollers or followers 46 with axes angularly spaced concentrically and equally about and from the axis of the shaft 20 so they align with and correspond to the spacing of the axes of the larger passages 42*c* at one end of each arcuate slot 42*a* when the guard is pivoted to an inoperative position.

Each follower or roller comprises, as shown in FIG. 4 a stud or shoulder bolt 46*a* an end portion of which is threaded, inserted into a hole and fastened with a nut to the inner side wall 44*a* of the guard. An opposite end portion of the stud 46*a* has an inner ball bearing race 46*b* mounted thereon and fixed against movement between an outwardly flared slotted head and shoulder on the stud 46*a*. The rollers 46 may rotate about either a plain sleeve bearing, roller bearings or as shown ball bearings situated between the inner race and outer bearing race or roller. On the outer periphery of each roller or outer bearing race 46 is a continuous circular groove, and recessed surface between opposed side flanges, into which portions of the opposed arcuate guide surfaces 42*b* extend, ride in, guide, roll and pivot the rollers 46 and attached guard 44 in an arcuate path about the axis of the shaft 20 during relative movement between the guard 44 and guide member 42. Alternatively, the groove and surfaces therein may have a configuration different from that shown. For example, they may be V-shape, U-shape or semi-circular shape and have surfaces which mate with the arcuate guide surfaces 42*b*. Also, the followers or rollers 46 could have but one flange engaging one side of the guide member and a recessed surface extending through the arcuate slot from the flange to the inner side wall of the guard on the opposite side of the guide member. Hence, the inner side wall would act as a flange and prevent axial movement of the guard toward the guide plate.

The followers or rollers 46 are obviously of sufficient axial thickness and greater in diameter to provide a groove and recessed surface, between opposed flanges, of sufficient width and depth to accept and retain the guide member 42 therein with a minimal amount of relative axial and radial movement. As shown in FIGS. 2 and 3 the guide member 42 is suitably fastened to and spaced from the adjacent side of the platform 16 an amount which allows the outer over hanging flange portion of one roller 46 to pass between the platform 16 and the guide plate 42. Also, the arcuate slots are of slightly greater width than the root or bottom diameter of the grooves whereby a little radial play exists between the outer opposed guide surfaces 42*b* and the rollers 46 so the outer guide surfaces do not oppose the rotation of the rollers by the inner guide surfaces.

The guard 44 is attached to the guide plate 32 by aligning the rollers 46 of smaller with the enlarged passages 42*c* in the guide plate, inserting the rollers into the passage until the grooves are aligned with the opposed arcuate guide surface 32*b* and pivoting the guard to move the rollers into the arcuate slots. Reversing the procedure allows the guard 44 to be detached from the guide member 42.

Link means are provided for pivoting the guard 44 and attach followers 46 relative to the guide member during pivotal movement of the platform 16 and saw blade 30 relative to the frame 12 and the workpiece support. The link means comprises a pivot pin or bolt 52 attached to and extending axially through the outer side wall 44*c* at the upper central portion of the guard 44. An end portion of the pivot pin projects beyond the wall 44*c* and is pivotally connected to an end portion of a removable connecting link or bar 54 extending to and pivotally connected by a quick disconnect pin 56 at its opposite end to the frame 12. The length of the connecting link bar 54 shown is fixed but can obviously be made in two relatively adjustable parts to vary the length thereof. However, the link bar is made to place and maintain the lower edge 44*d* of the guard 44 in a substantially horizontal or predetermined initial position regardless of the pivotal movement and position of the platform and saw blade relative to the frame.

As shown in FIG. 2 by phantom lines, it can be seen that during pivotal movement of the platform, guide member and saw blade relative to the work support or conveyor cart 32 the connecting link bar 54 pivots the guard 44 and attached rollers 46 in the arcuate slots 32*a* relative to the engaging guide member 42. When the guard is moved in response to pivotal movement, the inner arcuate guide surfaces 42b rotate and guide the engaging rotatable rollers 46 to different positions in the arcuate slots 42*a.* Hence, the guard 44 is likewise moved an arcuate distance substantially concentric about the saw blade 30 and axis of shaft 20.

Means are also provided for positioning and rocking or pivoting the platform and attached saw blade 30 relative to the frame 12 and work support cart 32. Referring to FIGS. 1–3, a saw blade positioning and pivoting mechanism is shown situated between spaced front and rear members of the frame 12. The mechanism comprises an elongated foot operated lever bar 62 pivotally connected at a rear end portion thereof to a pivot shaft 64 journalled in and extending between the spaced back or rear members 12*a* of the frame 12. The foot lever 64 has a relatively long lever arm extending from the axis of pivot shaft 64 and fulcrum point on the frame to the front of the rotary saw and a foot pedal or pad at its forward end.

Attached to and movable with the lever arm 62 is an upwardly extending support bracket or portion 62*a* provided with a resilient bumper or stop at its upper end. The lever 62, bracket 62*a* and bumper is resiliently biased upwardly to its initial rest or inoperative position and engagement with a cross member 12*d* of the frame 12 extending between the rails 12*b* by an extension spring 66 connected between the lever bar 62 and the cross member 12*d.*

A hand operable feed screw 68 is rotatably and pivotally journalled at 68*a* in a conventional self aligning bearing assembly fixed against axial movement on the upwardly extending portion 62*a* of the foot lever 62. A suitable self aligning bearing is an LFT-10 series sold under the tradename SEALMASTER and commercially available from Morse Chain Division of Borg Warner Corp., Ithaca, N. Y.

The feed screw 68 has a hand wheel or crank fixed to its forward end, extends axially rearwardly and threadedly engages a forward end portion of an adjustable threaded tube or rod 70 pivotally connected at its opposite rear end portion to one of three triangularly spaced pivot pins attached to a tripivot lever, link, or plate 72. Obviously, the lever plate 72 can be made in various geometric shapes, such as, straight, L-shape, V-shape, square, rectangular, circular, and still have three triangularly arranged pivots thereon. Preferably, the lever 72 as shown comprises a pair of spaced triangular shape plates between which extend three triangularly arranged pivot pins or bolts, holes and axes 72*a,* 72*b,* and 72*c* each located in or at a corner of the triangle defined thereby.

The first, center or fulcrum pivot pin 72*a* connects an intermediate offset portion or corner of the triangular link plate to the short lever arm 62*b* adjacent the rear end of the foot lever 62. The second or upper pivot pin 72*b* connects the upper corner or end of the lever plate to the rear end of the adjustable positioning rod 70. The third or lower pivot pin 72*c* connects the lower corner or portion of the lever 72 to the lower end portion of an upwardly extending push-pull rod 74. The push-pull rod 74 has between its opposite end portions a central offset portion 74*a* which extends upwardly at one side and behind the rear legs 12*a* of the frame 12 as shown in FIG. 3. An upper end portion of the push-pull rod then extends axially from the offset portion and is pivotally connected to the shorter lever arm or rear portion of the platform 16. Offsetting the portion 74*a* of the push-pull rod obviously allows cutting long workpieces which can extend between and beyond the back legs of the frame without interference.

In operation the saw blade positioning mechanism as shown in FIG. 1 can be preadjusted by rotating the hand wheel and feed screw 68 relative to the threaded rod or nut 70 which changes their total length, the position and distance of the pivot 72*b* from the support bracket 62*a* on lever 62. Changing the position of pivot 72*b* causes the triangular lever 72 to pivot about pivot 72*a* relative to the foot lever 62, the feed screw 68 to pivot in the self aligning bearing relative to the bracket 62*a* and to change the vertical position of pivot 72*c,* the push-pull rod 74 connected thereto and the saw blade 30.

Thus it is obvious that downward movement of the push-pull rod 74 pivots and raises the saw blade and upward movement pivots and lowers the saw blade relative to the work support cart 32.

By preadjusting the feed screw 68, rod 70 and lever 72 relative to the foot lever 62 the saw blade can be prepositioned at the desired elevation relative to a workpiece on the support cart without changing the position of foot lever 62 and thereafter, further pivoted downwardly into cutting position or engagement with the workpiece by depressing the foot lever 62. Pivotal movement of the foot lever 62 about the pivot shaft 64 does not change the adjusted relative positions of feed screw 68, rod 70 and lever 72 since they are mounted on and movable together with the foot lever 62. Also, the foot lever 62 and foot pedal thereon is returned by the spring 66 to the same inoperative starting position and elevation relative to the frame. Alternatively, the platform 16 and saw blade 30 may be pivoted by grasping and moving a handle bar 76 fixed to the forward end portion of the platform 16.

Having described and illustrated a preferred embodiment of the invention, it is to be understood that the present invention is not limited to the embodiment described but includes all modifications and equivalents falling within the scope of the following claims.

What is claimed is:

1. A rotary saw comprising:

a support frame;

a work support on the frame;

a platform pivotally connected to an upper portion of the frame and having a forward end portion extending above and pivotable toward and away from the work support;

bearing means on the forward end portion of the platform;

a shaft journalled in the bearing means;

a saw blade attached to the shaft for rotation about its axis;

drive means supported on the platform for rotating the saw blade;

a guide member attached to and extending adjacent the platform substantially normal to the axis of rotation and having at least one arcuate slot between opposed arcuate guide surfaces spaced radially from and extending arcuately about the axis of rotation;

a safety guard, pivotally supported on the guide member, enclosing a circular segment of the saw blade, and pivotable about the saw blade relative to the guide member and having a lower edge situated in a predetermined initial position; a follower attached to and projecting from a side of the guard into each arcuate slot and adapted for supporting, guiding and retaining engagement with the guide member during pivotal movement of the guard relative to the guide member;

link means, pivotally connected to the guard and frame, for pivoting and maintaining the lower edge of the guard in the predetermined initial position during pivotal movement of the saw blade relative to the work support and frame; and means for positioning and pivoting the platform and saw blade relative to the work support and frame.

2. A rotary saw according to claim 1 wherein the follower has:

at least one flange portion engageable with the guide member to retain the follower and the guard attached thereto from moving axially away from the guide member.

3. A rotary saw according to claim 2 wherein the follower has:

at least one circular flange engaging the guide member and a circular recessed surface of smaller diameter situated adjacent the circular flange and movable in the arcuate slot between the opposed arcuate guide surfaces.

4. A rotary saw according to claim 3 wherein the arcuate slot has at one end thereof:

an enlarged passage with which the follower can be aligned and passed into supporting, guiding and retaining engagement with the guide member during mounting the guard on the guide member.

5. A rotary saw according to claim 4 wherein the guide member has:

a plurality of the arcuate slots angularly spaced about and substantially concentric with the axis of rotation of the saw blade.

6. A rotary saw according to claim 5 wherein the follower comprises:

a roller rotatably mounted on the guard and having a pair of axially spaced flanges; and a groove, between the flanges, in which are situated portions of the opposed arcuate guide surfaces of the guide member.

7. A rotary saw according to claim 6 wherein the work support comprises:

a cart supported on and movable along guide rails fixed relative to the frame.

8. A rotary saw according to Claim 1 wherein the means for positioning and pivoting the platform and saw blade comprises:

a foot lever pivotally attached to and pivotable relative to the frame about a pivot axis and having a long lever arm portion extending forwardly of the pivot axis;

a short lever arm portion extending rearwardly of the pivot axis; and an upwardly extending portion on the long lever arm portion;

resilient means attached to the frame for biasing and maintaining the foot lever in a predetermined initial position relative to the frame; a rotatable and pivotable screw shaft extending rearwardly from, mounted and fixed against axial movement on the upwardly extending portion of the foot lever; an adjustable threaded member threaded to and extending rearwardly from the screw shaft; a tripivot lever including a center pivot pin pivotally connected to the rearwardly extending short lever arm portion of the foot lever, an upper pivot pin pivotally connected to an opposite end portion of the adjustable threaded member, and a lower pivot pin spaced from the upper pivot pin; and a push-pull rod pivotally connected at its upper end to the platform and at its lower end to the lower pivot pin on the tripivot lever whereby relative movement between the screw and adjustable threaded member changes their combined length, pivots the tripivot lever about the center pivot pin relative to the foot lever without changing the initial position of the foot lever relative to the frame, shifts the push-pull rod which changes the initial position of the platform and saw blade relative to the work support and depressing and pivoting the foot lever about the pivot axis on the frame simultaneously moves the screw, adjustable threaded member, tripivot lever, push-pull rod, platform and saw blade in unison relative to the frame.

9. A rotary saw according to claim 8 wherein the push-pull rod has:

an offset portion between the upper and lower ends which extends axially toward one side of the frame and out of alignment with an opening in the frame through which a workpiece may pass without interference.

10. A rotary saw comprising:

a support frame;

a work support on the frame;

a platform pivotally connected to an upper portion of the frame and having a forward end portion extending about and pivotable toward and away from the work support;

bearing means on the forward end portion of the platform;

a shaft journalled in the bearing means;

a saw blade attached to the shaft for rotation about its axis;

drive means supported on the platform for rotating the saw blade;

a saw blade guard, pivotally attached to, pivotable with and relative to the platform and enclosing a segment of the saw blade;

link means pivotally connected to the guard and frame for maintaining a lower edge of the guard in a predetermined initial position during pivotal movement of the platform and saw blade relative to the work support and frame; a foot lever pivotally attached to and pivotable relative to the frame about a pivot axis and having a long lever arm portion extending forwardly of the pivot axis, a short lever arm portion extending rearwardly of the pivot axis, and an upwardly extending portion on the long lever arm portion;

resilient means attached to the frame for biasing and maintaining the foot lever in a predetermined initial position relative to the frame; a rotatable and pivotable screw shaft extending rearwardly from, mounted, and fixed against axial movement on the upwardly extending portion of the foot lever;

an adjustable threaded member threaded to and extending rearwardly from the screw shaft;

a tripivot lever including a center pivot pin pivotally connected to the rearwardly extending short lever arm portion of the foot lever, an upper pivot pin pivotally connected to an opposite end portion of the adjustable threaded member, and a lower pivot pin spaced from the upper pivot pin; and a push-pull rod pivotally connected at its upper end to the platform and at its lower end to the lower pivot pin on the tripivot lever, whereby relative movement between the screw and adjustable threaded member changes their combined length, pivots the tripivot lever about the center pivot pin relative to the foot lever without changing the initial position of the foot lever relative to the frame, shifts the push-pull rod which changes the initial position of the platform and saw blade relative to the work support and depressing and pivoting the foot lever about the pivot on the frame simultaneously moves the screw, adjustable threaded member, tripivot lever, push-pull rod, platform and saw blade in unison relative to the frame.

11. A rotary saw according to claim 10 wherein the tripivot lever comprises:

a pair of spaced plates between which the pivot pins , the short lever arm portion of the foot lever, the opposite end portion of the adjustable threaded member and lower portion of the push-pull rod extend.

12. A rotary saw according to claim 11 wherein the center, upper and lower pivot pins are arranged on the tripivot lever with their axes in a triangular pattern and with the center pivot axis offset from a plane passing through axes of the upper and lower pivot pins.

13. A rotary saw comprising:

a support frame;

a work support on the frame;

a platform pivotally connected to an upper portion of the frame and having a forward end portion extending above and pivotable toward and away from the work support;

bearing means on the forward end portion of the platform;

a shaft journalled in the bearing means;

a saw blade attached to the shaft for rotation about its axis;

drive means supported on the platform for rotating the saw blade;

a safety guard enclosing a segment of the saw blade and pivotable about the saw blade relative to the platform and having a lower edge situated in a predetermined initial position;

guide means operable between the safety guard and the platform for supporting, retaining and guiding the safety guard for pivotal movement relative to the platform including a guide member extending adjacent the platform substantially normal to the axis of rotation and having at least one arcuate slot between opposed arcuate guide surfaces spaced radially from and extending arcuately about the axis of rotation, and a follower projecting into each arcuate slot and adapted for supporting, guiding and retaining engagement with the guide member and relative pivotal movement between the guide member and the follower;

link means, pivotally connected to the guard and frame, for pivoting and maintaining the lower edge of the guard in the predetermined initial position during pivotal movement of the saw blade relative to the work support and frame; and means for positioning and pivoting the platform and saw blade relative to the work support and frame.

* * * * *